US012709854B2

(12) United States Patent
Van Der Zee et al.

(10) Patent No.: US 12,709,854 B2
(45) Date of Patent: Aug. 18, 2026

(54) VESSEL AND A METHOD OF INSERTING A MONOPILE INTO A GUIDE

(71) Applicant: IQIP HOLDING B.V., Sliedrecht (NL)

(72) Inventors: Alexander Maarten Van Der Zee, Delft (NL); Jurgen Arjan Zijlmans, Barendrecht (NL); Fabian Corijn Bakker, Capelle aan den Ijssel (NL); Bram Van Den Berg, Lopik (NL); Jacob Osnabrugge, Scherpenzeel (NL)

(73) Assignee: IQIP HOLDING B.V., Sliedrecht (NL)

( * ) Notice: Subject to any disclaimer, the term of this patent is extended or adjusted under 35 U.S.C. 154(b) by 54 days.

(21) Appl. No.: 18/708,504

(22) PCT Filed: Nov. 10, 2022

(86) PCT No.: PCT/NL2022/050638
§ 371 (c)(1),
(2) Date: May 8, 2024

(87) PCT Pub. No.: WO2023/085930
PCT Pub. Date: May 19, 2023

(65) Prior Publication Data

US 2025/0012030 A1 Jan. 9, 2025

(30) Foreign Application Priority Data

Nov. 11, 2021 (NL) ..... 2029720

(51) Int. Cl.
*E02B 17/02* (2006.01)
*E02B 17/00* (2006.01)

(52) U.S. Cl.
CPC ..... *E02B 17/02* (2013.01); *E02B 2017/0047* (2013.01); *E02B 2017/0065* (2013.01)

(58) Field of Classification Search
CPC ..... E02B 17/02; E02B 2017/0047; E02B 2017/0065; E02B 2017/0039;
(Continued)

(56) References Cited

U.S. PATENT DOCUMENTS

2020/0308796 A1* 10/2020 Vehmeijer ..... E02D 13/04
2020/0347960 A1* 11/2020 Roodenburg ..... F16L 1/207
(Continued)

FOREIGN PATENT DOCUMENTS

TW I640673 B 11/2018
WO 2021148479 A2 7/2021

OTHER PUBLICATIONS

International Search Report and Written Opinion in corresponding International Application No. PCT/NL2022/050638 dated Feb. 2, 2023.

(Continued)

*Primary Examiner* — Carib A Oquendo
(74) *Attorney, Agent, or Firm* — Steven M. Koehler; Westman, Champlin & Koehler, P.A.

(57) ABSTRACT

A vessel comprises a hull and a guide for guiding a monopile. The guide is movably mounted to the hull and includes a receiving part and a closure part which is movable for creating a closed condition of the guide where the guide forms an annular body extending in a main plane and an open condition in which the guide has an opening to a space, allowing a monopile to be received in the space. A displacing device displaces the guide within the main plane. A control system controls the displacing device and such that it determines an oscillating path of a monopile relative to the hull in a direction within the main plane when the monopile and the guide are moving towards each other and the guide is in the open condition for receiving the monopile. The
(Continued)

displacing device displaces the guide substantially synchronously with the determined oscillating path.

19 Claims, 4 Drawing Sheets

(58) Field of Classification Search
CPC . E02B 2017/0091; E02B 17/04; B66C 23/52; E02D 13/04; B63B 35/003; B63B 2017/0072; F03D 13/25
See application file for complete search history.

(56) References Cited

U.S. PATENT DOCUMENTS

| | | | | |
|---|---|---|---|---|
| 2021/0123203 | A1* | 4/2021 | Rabaut | E02D 7/00 |
| 2023/0046101 | A1* | 2/2023 | Meskers | B63B 27/10 |
| 2023/0073785 | A1* | 3/2023 | Konate | F03D 13/25 |

OTHER PUBLICATIONS

Office Action in corresponding Taiwanese application serial No. 111142483 dated Oct. 16, 2025.

* cited by examiner

VESSEL AND A METHOD OF INSERTING A MONOPILE INTO A GUIDE

CROSS-REFERENCE TO RELATED APPLICATION(S)

This Application is a Section 371 National Stage Application of International Application No. PCT/NL2022/050638, filed Nov. 10, 2022 and published as WO 2023/085930 A1 on May 19, 2023, in English.

BACKGROUND

The present invention relates to a vessel, comprising a hull and a guide for guiding a monopile to be driven into a seabed, which guide is movably mounted to the hull and provided with a receiving part and a closure part which is movable with respect to the receiving part for creating a closed condition of the guide in which closed condition the guide forms an annular body extending in a main plane and an open condition in which the guide has an opening to a space which is bordered by the receiving part, allowing a monopile to be received in the space via the opening and a displacing device for displacing the guide within the main plane with respect to the hull and a control system for controlling the displacing device.

A vessel including such a guide, which is also called a wave-induced motion compensated pile gripper, is known in the art. The motion compensation allows the gripper to compensate the disturbing vessel motions. Installing a monopile from a floating vessel has great advantages since it allows higher pay-loads and crane capacities than jack-up barges and requires less time for positioning the vessel such that the total time of installing monopiles is minimized, but it is challenging because of wave-induced vessel motions and monopile motions. When a monopile is hung below a cable of a crane at the vessel and inserted into the mentioned space through the opening in the guide the wave-induced motions may lead to collisions between the monopile and the guide. It is noted that in practice a lower section of the monopile may be located in the water during inserting the monopile into the guide which may also lead to wave-induced motions of the monopile.

SUMMARY

An object of the invention is to provide a vessel which minimizes the risk of collisions.

This object is accomplished with the vessel, wherein the control system is configured such that it determines an oscillating path of a monopile with respect to the hull in a direction within the main plane when the monopile and the guide are moving toward each other and the guide is in the open condition for receiving the monopile and such that the displacing device displaces the guide substantially synchronously with the determined oscillating path in the same direction thereof.

An advantage of the present invention is that the guide has an active motion compensation to avoid collisions between the monopile and the guide during receiving the monopile by the guide. If a monopile is hung below a hoisting cable of a crane on the vessel the monopile usually oscillates such that the monopile at the level of the main plane follows an oscillating path with respect to the hull within the main plane in a certain direction. When the guide and the monopile are moved to each other, the guide can follow the oscillating path such that there is a low risk of collision when they approach each other. If nevertheless a collision occurs the impact will be relatively small because of the limited relative velocity of the guide and the monopile. This allows a fast process of receiving a monopile, also in severe weather conditions.

It is noted that when the monopile is moved to the guide its motion with respect to the hull is a superposition of the displacement towards the guide and its oscillating path. In practice the average speed at which the monopile and the guide approach each other will be much lower than the maximum speed of the monopile with respect to the hull along the oscillating path.

In a particular embodiment the control system is configured such that it decomposes the direction in a first component which is towards the guide and away from the guide and a second component which extends transversely to the first component, wherein when the determined oscillating path is located at a first distance from the receiving part the displacing device displaces the guide along the first and second components, whereas when the determined oscillating path is located at a second distance from the receiving part which is larger than the first distance the displacing device displaces the guide along the second component only. This means that when the monopile and the guide are approaching each other the guide is first displaced along the second component only and when the monopile is close to the receiving part it will also be displaced along the first component. The reason for this is that during a first part of approaching the guide the clearance between the receiving part and the monopile along the first component is larger than along the second component. In practice the first component may be perpendicular to the opening in the annular body.

In the closed condition the guide may be substantially circular within the main plane such that the receiving part is partly circular within the main plane. Nevertheless, alternative shapes are conceivable. The receiving part may have numerous partly annular shapes.

The closure part may comprise a pair of doors which are pivotally mounted to the receiving part and open in opposite directions with respect to each other in outward direction of the guide, preferably independently from each other. This provides the opportunity to create a large access to the space that is bordered by the receiving part.

In a practical embodiment the displacing device is provided with linear actuators, such as hydraulic cylinders or a rack and pinion system, which operate along lines of action that extend perpendicularly to each other.

The control system may comprise a position sensor for determining the actual location of a monopile with respect to the guide so as to determine the oscillating path. This also enables the control system to derive the actual velocity of the monopile along the oscillating path. Additionally, motion measurement sensors may be applied, for example at the monopile and/or at lifting tools for hoisting the monopile so as to accurately determine the actual position and velocity of the monopile.

The control system may also comprise an inclination angle sensor for determining an actual inclination angle of the monopile. The actual inclination angle is a useful parameter, which provides in combination with the actual position of the monopile an accurate indication of the actual motion characteristics of the monopile, which facilitates an accurate control of the position of the guide.

The position sensor may be based on radar, laser or lidar technology, but it may also be a vision system or a mechanical system which touches the monopile. Radar and lidar technology are preferred since they are applicable under all weather conditions. In order to determine the actual position of the monopile in an accurate way a plurality of position sensors may be applied.

The position sensor may be located at the guide, preferably at the receiving part in order to achieve an accurate measurement of the position of the monopile relative to the guide. This enables the control system to accurately follow the oscillating path of the monopile within the main plane. It is also conceivable to locate the position sensor at the hull.

The vessel may be provided with a crane for hoisting a monopile and moving the hoisted monopile towards the guide.

The guide and/or the displacing device may be provided with a damping device for mitigating collisions between a monopile and the guide.

In a particular embodiment the damping device comprises damping elements at an inner circumference of the guide, or more specifically, at an inner side of the receiving part.

The guide may be rotatable with respect to the hull about an axis which extends perpendicularly to the main plane. This provides the opportunity to vary the orientation of the opening such that it can be directed to a monopile when the monopile and the opening are approaching each other. It is noted that this configuration is also conceivable without the feature that the control system is configured such that it displaces the guide substantially synchronously with the determined oscillating path. In other words, the invention also relates to a vessel, comprising a hull and a guide for guiding a monopile to be driven into a seabed, which guide is movably mounted to the hull and provided with a receiving part and a closure part which is movable with respect to the receiving part for creating a closed condition of the guide in which closed condition the guide forms an annular body extending in a main plane and an open condition in which the guide has an opening to a space which is bordered by the receiving part, allowing a monopile to be received in the space via the opening, a displacing device for displacing the guide within the main plane with respect to the hull and a control system for controlling the displacing device, wherein the guide is rotatable with respect to the hull about an axis which extends perpendicularly to the main plane. The vessel may be provided with other features as described hereinbefore, for example the guide and/or the displacing device may be provided with a damping device for mitigating collisions between a monopile and the guide.

The invention is also related to a method of inserting a monopile to be driven into a seabed into a guide for guiding the monopile, which guide is movably mounted to a hull of a vessel and provided with a receiving part and a closure part which is movable with respect to the receiving part for creating a closed condition of the guide in which closed condition the guide forms an annular body extending in a main plane and an open condition in which the guide has an opening to a space which is bordered by the receiving part, allowing a monopile to be received in the space via the opening, wherein in the open condition the monopile and the guide are moved to each other, during which movement an oscillating path of the monopile with respect to the hull within the main plane is determined and the guide is displaced substantially synchronously with the determined oscillating path in the same direction thereof.

In a particular embodiment the direction is decomposed in a first component which is towards the guide and away from the guide and a second component which extends transversely to the first component, wherein when the determined oscillating path is located at a first distance from the receiving part the guide is displaced along the first and second components, whereas when the determined oscillating path is located at a second distance from the receiving part which is larger than the first distance the guide is displaced along the second component only.

In practice, after inserting the monopile into the guide the closure part is closed, during which and/or after which the guide is displaced such that a counterforce is applied on the monopile in order to minimize the amplitude of the oscillating path.

It is also possible that after inserting the monopile into the guide the closure part is closed, during which and/or after which a remaining oscillating motion of the guide including the monopile is dampened.

BRIEF DESCRIPTION OF THE DRAWINGS

Aspects of the invention will hereafter be elucidated with reference to the schematic drawings showing an embodiment of the invention by way of example.

DETAILED DESCRIPTION OF ILLUSTRATIVE EMBODIMENTS

Figure 1:
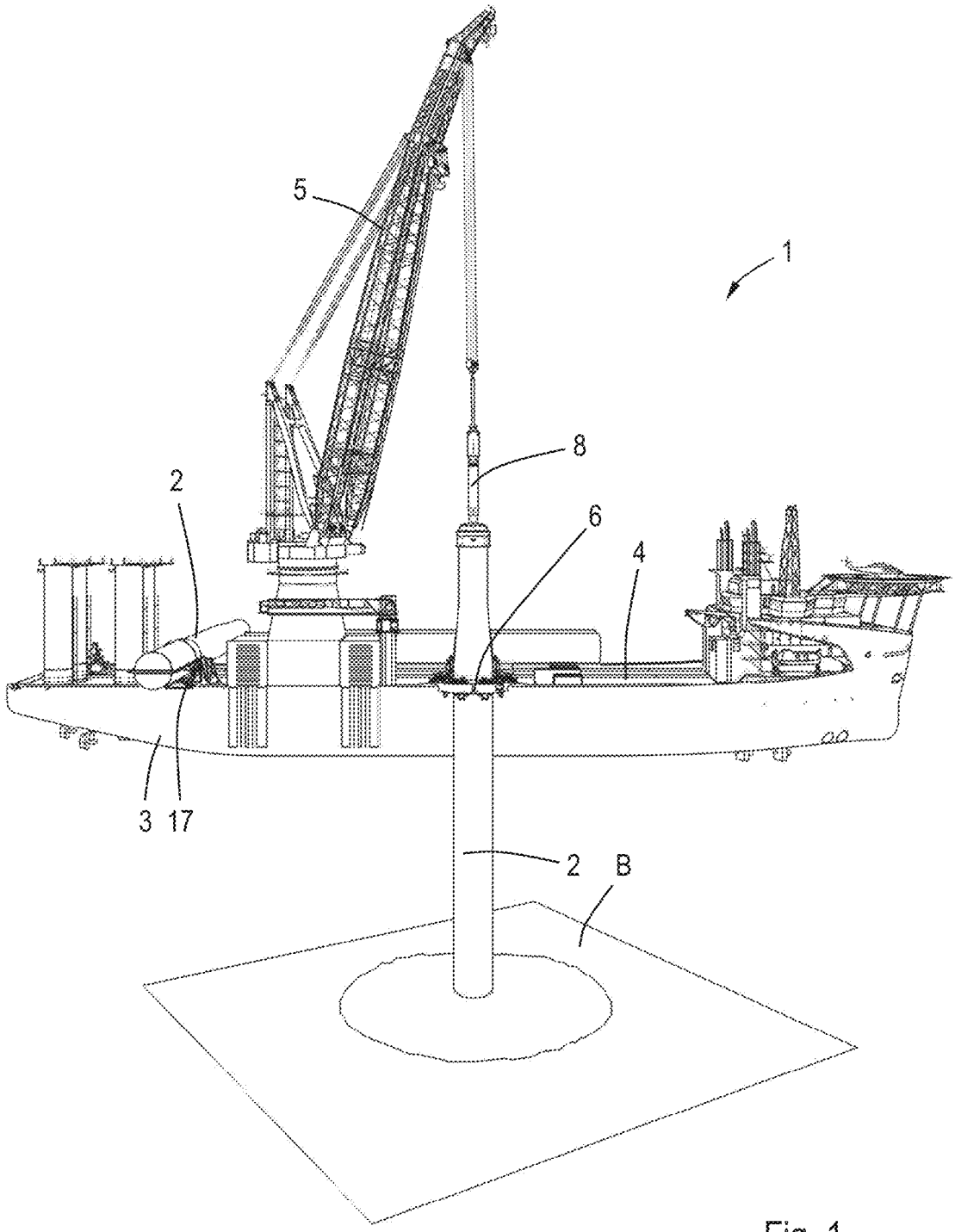
FIG. 1 is a perspective view of an embodiment of a vessel.

FIG. 1 shows a floating installation vessel 1 for installing a monopile 2 in a seabed B. The installation vessel 1 has a hull 3 including an upper deck 4. A crane 5 for lifting the monopile 2 is mounted to the hull 3. The installation vessel 1 is also provided with a guide 6 for guiding the monopile 2 in its longitudinal direction during driving the monopile 2 into the seabed B.

Figure 2:
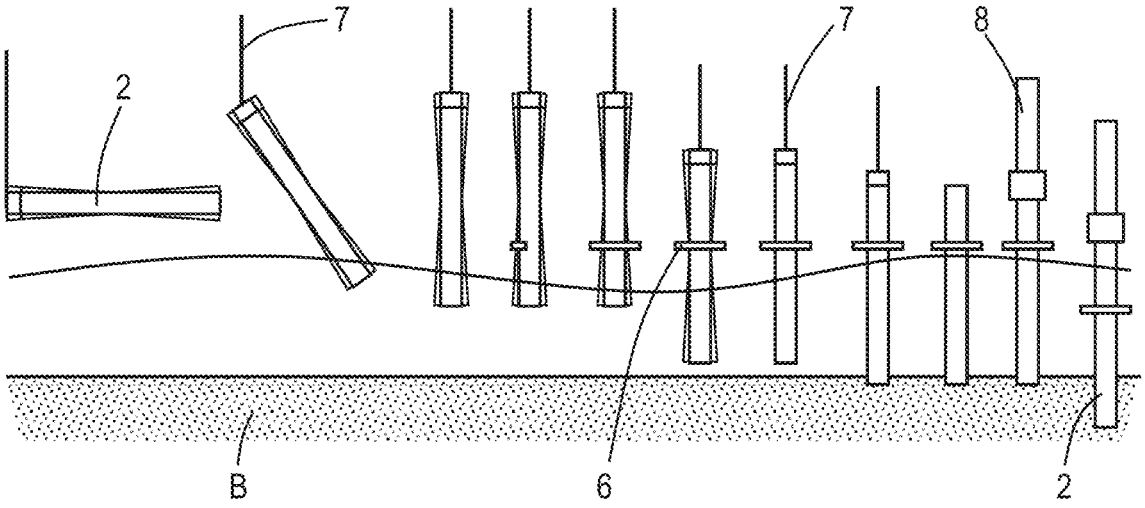
FIG. 2 is an illustrative view of successive activities from hoisting a monopile from the vessel as shown in FIG. 1 to driving the monopile into a seabed.

Under operating conditions, the monopiles 2 are transported horizontally by the installation vessel 1 from a production facility to an off-shore installation site. FIG. 2 illustrates a number of successive activities at the off-shore installation site. One of the monopiles 2 is up-ended by means of the crane 5, assisted with a hinge 17, as shown in FIG. 1, that supports the monopile 2 on the deck 4, after which the monopile 2 suspends vertically from a cable 7 of the crane 3. Subsequently, the monopile 2 is received by the guide 6 and placed onto the seabed B, after which the cable 7 is separated from the monopile 2. Then, a pile driving device 8 is placed on top of the monopile 2 by the crane 5 in order to drive the monopile 2 into the seabed B. Alternatively, a split block crane is present, wherein an upper end and lower end of the monopile 2 can be lifted separately such that the crane can perform upending on its own without the hinge 17.

Figure 3:
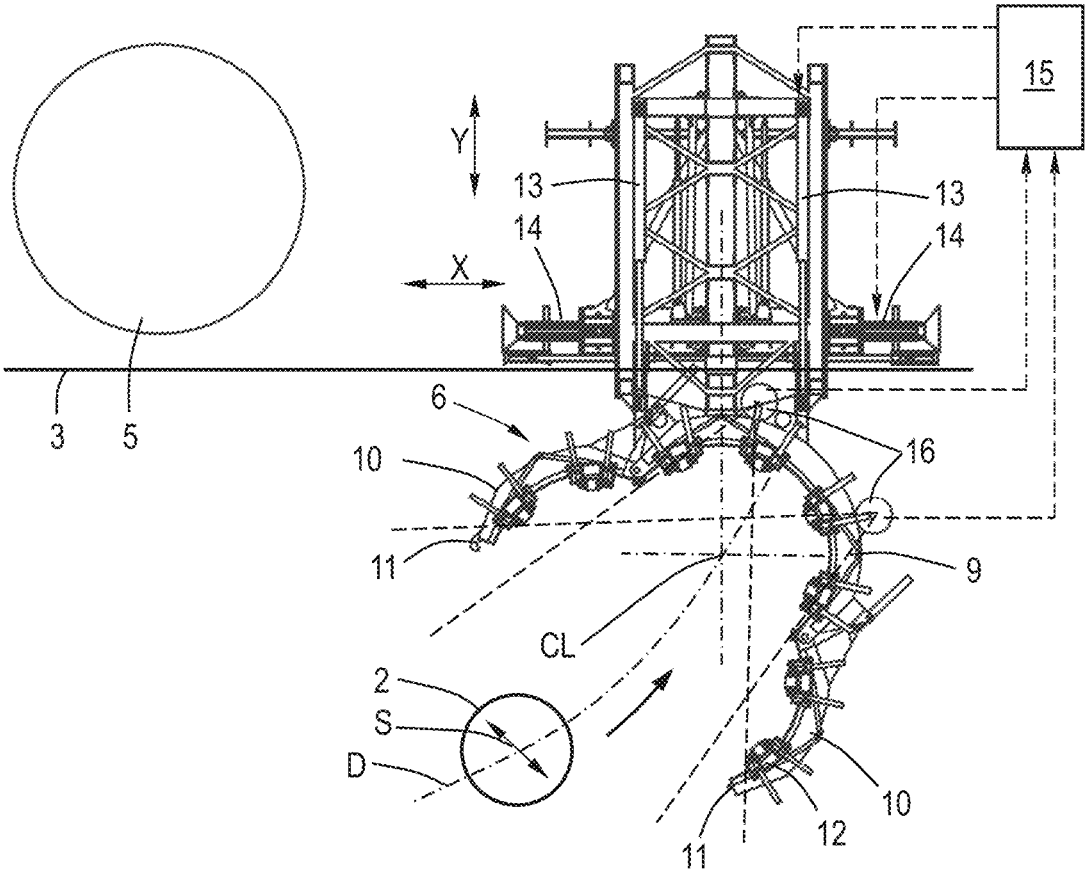
FIG. 3 is an enlarged top view of a part of the vessel as shown in FIG. 1, showing a guide for guiding a monopile to be driven into the seabed.
Figure 4:
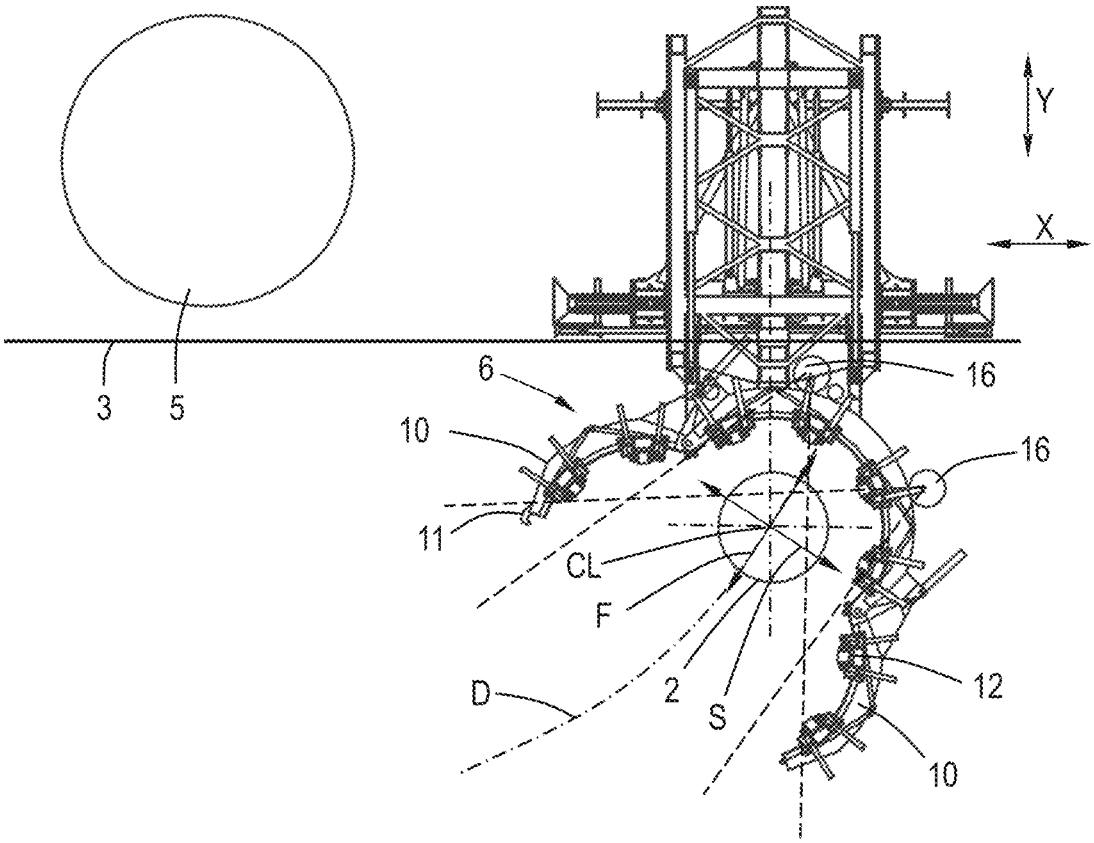
FIG. 4 is a similar view as FIG. 3, but illustrating a different situation.

The guide 6 has an open condition and a closed condition. The open condition is shown in FIGS. 3 and 4. In the closed condition the guide 6 forms an annular body for enveloping a monopile 2. The annular body extends in a main plane. In this case the annular body is substantially circular and has a centerline CL. The main plane is substantially parallel to the upper deck 4 of the installation vessel 1, which is horizontal in the event of a calm sea. The guide 6 is provided with a receiving part 9 and a closure part in the form of a pair of doors 10 which open in opposite directions with respect to each other in outward direction of the guide 6. In the open condition the guide 6 has an opening which enables a monopile 2 to be inserted into a space that is bordered by the receiving part 9. The receiving part 9 in the embodiment as shown in FIGS. 3 and 4 is semi-circular. The doors 10 can be locked to each other through cooperating locking members 11. The guide 6 may have a different shape than shown in FIGS. 3 and 4, whereas the doors 10 may be replaced by a single door, for example.

The guide 6 is provided with retractable pile supports or so-called bogeys 12, which are guide arms including rollers. The bogeys 12 are moved towards the centerline CL before pile driving starts, i.e. when the monopile 2 is located in the guide 6 and the guide 6 is in its closed condition. In the open condition of the guide 6 the bogeys 12 are retracted in order to allow the monopile 2 to enter the space which is bordered by the receiving part 9 and to minimize the risk of collisions between the bogeys 12 and the monopile 2. In this case the bogeys 12 lie on an imaginary circle when the guide 6 is in the closed condition and the bogeys 12 are retracted.

The installation vessel 1 comprises a displacing device in the form of a pair of first hydraulic cylinders 13 and a pair of second hydraulic cylinders 14. The first hydraulic cylinders 13 operate along a first line of action Y and the second hydraulic cylinders 14 operate along a second line of action X which is perpendicular to the first line of action Y. The first and second lines of action X, Y extend parallel to the main plane. Consequently, the guide 6 is movable with respect to the upper deck 4 within the main plane. Alternatively, the first and second hydraulic cylinders 13, 14 may be replaced by other linear actuators such as a rack and pinion system, a winch or the like.

FIGS. 3 and 4 illustrate a desired path D which is followed by an axial centerline of the monopile 2 at the level of the main plane towards the centerline CL of the guide 6. The partly circular path D or slewing trajectory is caused by the rotating motion of the crane 5. Such a circular path D may be followed in case of a very calm sea. However, since the monopile 2 is installed from the floating installation vessel 1, the monopile 2 will oscillate due to motion of the installation vessel 1 and due to waves when a lower portion of the monopile 2 is located in the sea, in practice. This is illustrated in FIG. 2. Usually, the monopile 2 oscillates about its center of gravity which lies at a distance of, and often above, the main plane of the guide 6.

In order to prevent the guide 6 and the monopile 2 from collisions during inserting the monopile 2 into the space that is bordered by the receiving part 9 the installation vessel 1 is provided with a control system 15 for controlling the first and second hydraulic cylinders 13, 14 such that the guide 6 moves substantially synchronously with an oscillating path of the approaching monopile 2. For this reason the installation vessel 1 comprises position sensors 16 at the receiving part 9, see FIG. 3. In this case, each of the position sensors 16 covers a detection range of which the borders are indicated by broken lines in FIG. 3. Signals from the position sensors 16 are received by the control system 15. On the basis of these signals the control system 15 determines the actual oscillating path of the monopile 2 with respect to the guide 6 in the main plane when the monopile 2 is being moved towards the guide 6. The control system 15 controls the hydraulic cylinders 13, 14 such that the guide 6 is displaced substantially synchronously with the determined oscillating path of the monopile 2 in the same direction thereof. In other words the guide 6 follows the oscillating motion of the monopile 2. The position sensors 16 and the control system 15 may be configured such that a ceterline of the monopile 2 is determined. This provides the opportunity to use the centerline of the monopile 2 as a reference which should be followed by the centerline CL of the guide 6.

In the embodiment as shown in the figures, the control system 15 decomposes the determined oscillating path in a first component F which is directed towards the guide 6 and away from the guide 6 and a second component S which extends perpendicularly to the first component F, see FIG. 4. When the determined oscillating path is located close to the receiving part 9 of the guide 2, i.e. at a first distance from the receiving part 9, the control system 15 controls the hydraulic cylinders 13, 14 such that the guide 6 is displaced along both the first component F and the second component S. When the determined oscillating path is located at a greater distance from the receiving part 9, i.e. at a second distance from the receiving part 9 which is larger than the first distance, the guide 6 is displaced along the second component S only. The latter situation is illustrated in FIG. 3. The reason for this control strategy is that when the monopile 2 is approaching the guide 6 the risk of a collision between the receiving part 9 and the monopile 2 along the second component S is higher than along the first component F, whereas when the monopile 2 is close to the receiving part 9 the risk of a collision in both directions increases. Hence, the monopile 2 passes the opening of the guide 6 at maximum clearance at opposite sides thereof.

The guide 6 and/or the first and second hydraulic cylinders 13, 14 may be provided with a damping device for mitigating collisions between the monopile 2 and the guide 6. For example, the bogeys 12 may comprise damping elements (not shown).

Figure 5:
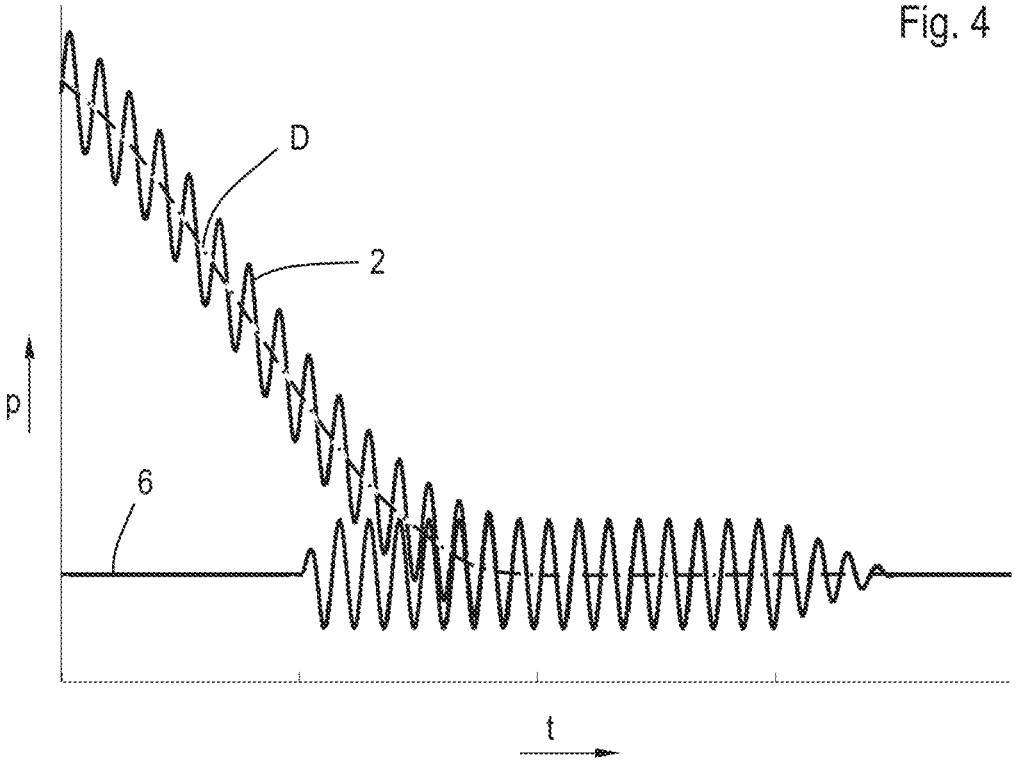
FIG. 5 is a diagram, showing actual positions of the guide and the monopile of FIGS. 3 and 4 as a function of time.

The actions of the control system 15 are visualized in FIG. 5. This figure shows the actual positions P of the centerline CL of the guide 6 and the centerline of a monopile 2 as a function of time t. The centerline of the monopile 2 oscillates about a curve which represents the average movement of the centerline of the monopile 2 towards the guide 6. The curve is given reference sign D in order to indicate that it represents the path D as shown in FIGS. 3 and 4. At the left part of FIG. 6 it can be seen that the oscillating monopile 2 approaches the guide 6, whereas the guide 6 is still not displaced by the control system 15. At a certain moment the distance between the monopile 2 and the guide 2 becomes smaller than a predetermined value. The motion compensation can be started as soon as the monopile 2 arrives in the range of the position sensors 16. Subsequently, the guide 6 starts to follow the oscillating path of the monopile 2 within the main plane. As a consequence the monopile 2 can safely move further inside the space that is bordered by the receiving part 9 and finally, as soon as the centerline of the monopile 2 substantially coincides with the centerline CL of the guide 6 the doors 10 are closed and the bogeys 12 are extended. Then, the control system 15 may control the hydraulic cylinders 13, 14 such that the guide 6 counteracts the oscillating motion of the monopile 2 in order to stabilize the monopile 2 with respect to the hull 3. After stabilizing the monopile 2 with respect to the hull 3 the monopile 2 needs to be actively positioned with respect to the sea bottom B as it needs to be stabbed at the right target location. After that, the hoisting cable 7 may be decoupled from the monopile 2 and a pile driving device 8 can be placed on top of the monopile 2 in order to drive the monopile 2 into the seabed B.

Figure 6:
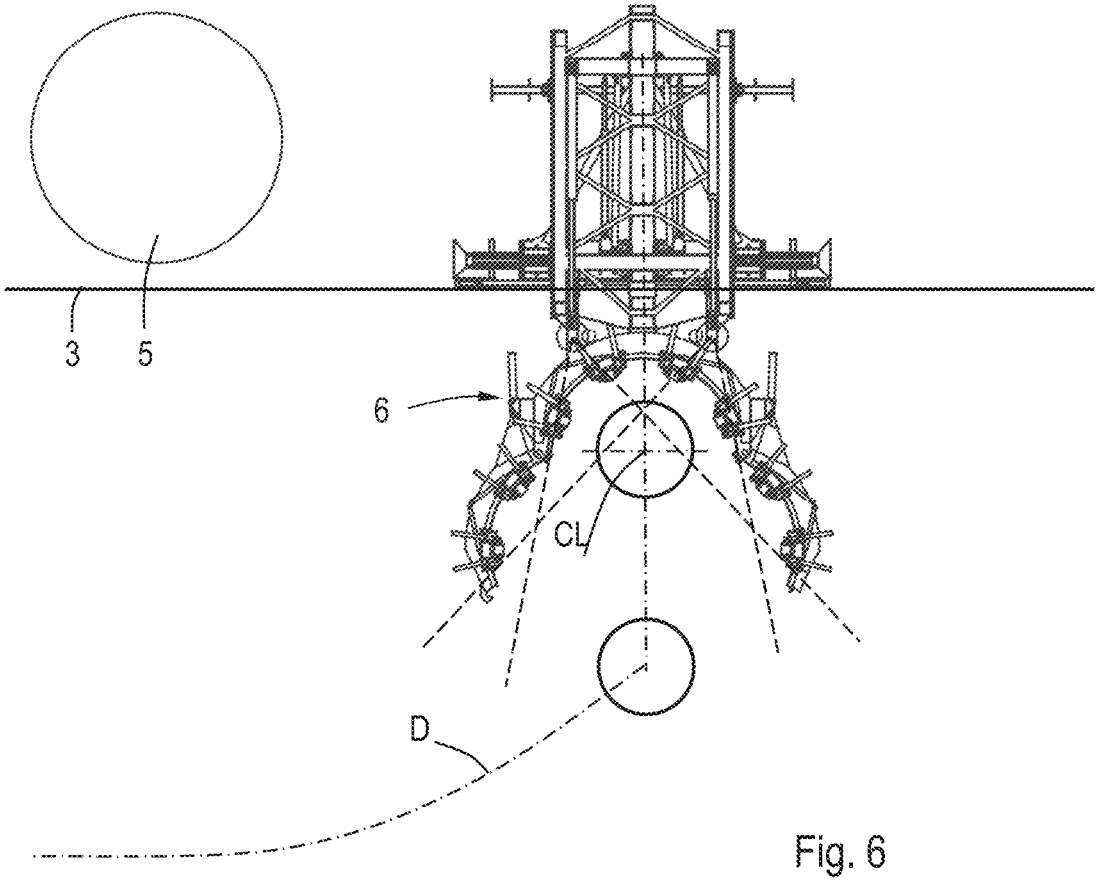
FIG. 6 is a similar view as FIG. 3, but showing the guide in a different orientation.

FIG. 6 shows that the guide 6 is rotatable with respect to the hull 3 about an axis that extends perpendicular to the main plane of the guide 6. Consequently, the opening can be directed in a different direction in the open condition of the guide 6. In the situation as shown in FIG. 6 the opening is directed in a direction perpendicularly with respect to a longitudinal axis of the hull 3. Hence, the centerline CL of the guide is not located at an end of the partly circular path D of the monopile 2 towards the guide 6 such as in the conditions as shown in FIGS. 3 and 4.

The invention is not limited to the embodiment shown in the drawings and described hereinbefore, which may be varied in different manners within the scope of the claims and their technical equivalents.

The invention claimed is:

1. A vessel, comprising:

a hull;

a guide configured to guide a monopile to be driven into a seabed, which guide is movably mounted to the hull and provided with a receiving part and a closure part, which is movable with respect to the receiving part for creating a closed condition of the guide in which closed condition the guide forms an annular body extending in a main plane and an open condition in which the guide has an opening to a space which is bordered by the receiving part, allowing the monopile to be received in the space via the opening;

a displacing device configured to displace the guide within the main plane with respect to the hull; and a control system configured to control the displacing device, wherein the control system is configured such that the control system determines an oscillating path of the monopile with respect to the hull in a direction within the main plane when the monopile and the guide are moving towards each other and the guide is in the open condition for receiving the monopile and such that the displacing device displaces the guide synchronously with the determined oscillating path in a same direction thereof, wherein the control system comprises a position sensor configured to determine an actual location of the monopile with respect to the guide so as to determine the oscillating path.

2. The vessel according to claim 1, wherein the control system is configured such that the control system decomposes a direction in a first component which is towards the guide and away from the guide and a second component which extends transversely to the first component, wherein when the determined oscillating path is located at a first distance from the receiving part, the displacing device displaces the guide along the first and second components, whereas when the determined oscillating path is located at a second distance from the receiving part, which is larger than the first distance, the displacing device displaces the guide along the second component only.

3. The vessel according to claim 1, wherein in the closed condition, the guide is substantially circular within the main plane such that the receiving part is partly circular within the main plane.

4. The vessel according to claim 1, wherein the closure part comprises a pair of doors which are pivotally mounted to the receiving part and open in opposite directions with respect to each other in outward direction of the guide.

5. The vessel according to claim 1, wherein the displacing device is provided with linear actuators, which operate along lines of action that extend perpendicularly to each other.

6. The vessel according to claim 5, wherein the linear actuators comprise hydraulic cylinders.

7. The vessel according to claim 5, wherein the linear actuators comprise a rack and pinion system.

8. The vessel according to claim 1, wherein the position sensor is located at the guide.

9. The vessel according to claim 8, wherein the position sensor is located at the receiving part.

10. The vessel according to claim 1, wherein the vessel is provided with a crane configured to hoist the monopile and move the hoisted monopile towards the guide.

11. The vessel according to claim 1, wherein the control system comprises an inclination angle sensor configured to determine an actual inclination angle of the monopile.

12. The vessel according to claim 1, wherein the guide and/or the displacing device is provided with a damping device configured to mitigate collisions between a monopile and the guide.

13. The vessel according to claim 12, wherein the damping device comprises damping elements at an inner circumference of the guide.

14. The vessel according to claim 1, wherein the guide is rotatable with respect to the hull about an axis which extends perpendicularly to the main plane.

15. A method of inserting a monopile to be driven into a seabed into a guide for guiding the monopile, which guide is movably mounted to a hull of a vessel and provided with a receiving part and a closure part which is movable with respect to the receiving part for creating a closed condition of the guide in which closed condition the guide forms an annular body extending in a main plane and an open condition in which the guide has an opening to a space which is bordered by the receiving part, the method comprising:

receiving a monopile in the space via the opening;

in the open condition moving the monopile and the guide to each other, during which movement an oscillating path of the monopile with respect to the hull within the main plane is determined; and displacing the guide synchronously with the determined oscillating path in a same direction thereof.

16. The method according to claim 15, wherein the direction is decomposed in a first component which is towards the guide and away from the guide and a second component which extends transversely to the first component, wherein when the determined oscillating path is located at a first distance from the receiving part the guide is displaced along the first and second components, whereas when the determined oscillating path is located at a second distance from the receiving part which is larger than the first distance the guide is displaced along the second component only.

17. The method according to claim 15, wherein after inserting the monopile into the guide, the closure part is closed, during which and/or after which the guide is displaced such that a counterforce is applied on the monopile in order to minimize an amplitude of the oscillating path.

18. The method according to claim 15, wherein after inserting the monopile into the guide the closure part is closed, during which and/or after which a remaining oscillating motion of the guide including the monopile is dampened.

19. The vessel according to claim 1, wherein the closure part comprises a pair of doors which are pivotally mounted to the receiving part and open in opposite directions with respect to each other in outward direction of the guide independently from each other.

* * * * *